United States Patent [19]

Simpson

[11] 4,203,727

[45] May 20, 1980

[54] PROCESS FOR REDUCING THE SULFUR CONTENT OF COAL

[76] Inventor: Charles H. Simpson, 7749 E. Chaparral Rd., Scottsdale, Ariz. 85253

[21] Appl. No.: 964,742

[22] Filed: Nov. 29, 1978

[51] Int. Cl.[2] ..... C10L 9/10; C01B 17/14

[52] U.S. Cl. ..... 44/1 SR; 423/578 A

[58] Field of Search ..... 44/1 SR; 201/17; 422/262; 423/578 A, 567, 461

[56] References Cited

U.S. PATENT DOCUMENTS

| | | | |
|---|---|---|---|
| 44,817 | 10/1864 | Penniman | 44/1 SR |
| 3,063,817 | 11/1962 | Simpson | 422/262 X |
| 3,926,575 | 12/1975 | Meyers | 44/1 SR |

*Primary Examiner*—Carl F. Dees

*Attorney, Agent, or Firm*—William H. Drummond

[57] ABSTRACT

Raw coal containing sulfur impurities and water is ground in a vapor-tight extraction zone in contact with a combustible sulfur solvent at an elevated temperature. An extraction mixture slurry is formed which includes a liquid component comprising the solvent and sulfur impurities and a solid component comprising the comminuted, extracted coal. The liquid and solid components of the slurry are separated. At least a portion of the liquid component is preferably treated to separate sulfur. The liquid component is recycled to the extraction zone.

If the solid slurry component has an undesirably high pyrite content, it is then reacted with a reagent to decompose the pyrites to water-soluble sulfur compounds and the reaction mixture is washed with water.

2 Claims, 1 Drawing Figure

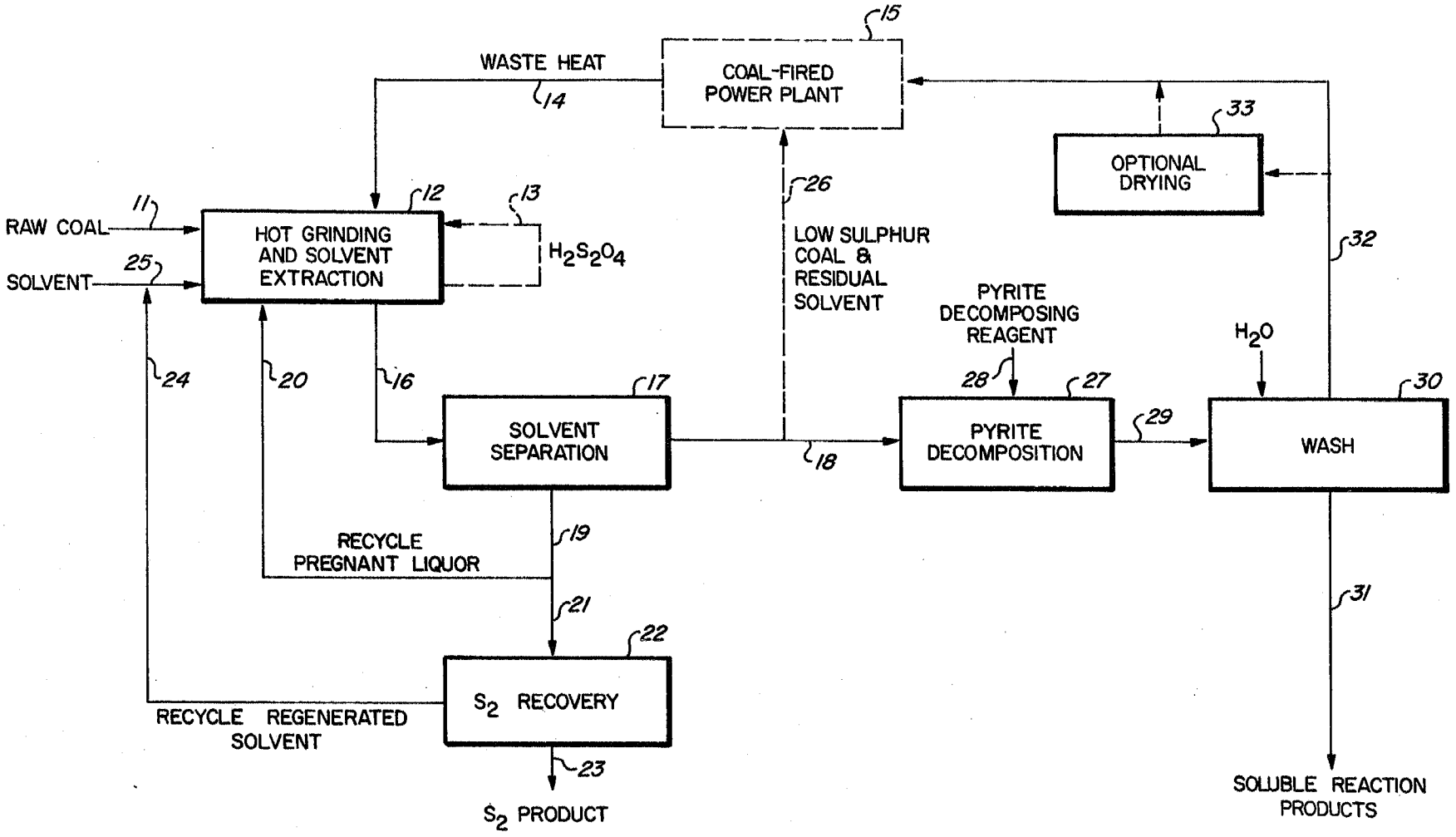
RAW COAL
11
SOLVENT
25
HOT GRINDING AND SOLVENT EXTRACTION
12
13
$H_2S_2O_4$
WASTE HEAT
14
COAL-FIRED POWER PLANT
15
20
16
24
SOLVENT SEPARATION
17
RECYCLE PREGNANT LIQUOR
19
21
LOW SULPHUR COAL & RESIDUAL SOLVENT
26
18
PYRITE DECOMPOSING REAGENT
28
PYRITE DECOMPOSITION
27
29
OPTIONAL DRYING
33
32
WASH
30
$H_2O$
31
SOLUBLE REACTION PRODUCTS
$S_2$ RECOVERY
22
RECYCLE REGENERATED SOLVENT
$S_2$ PRODUCT
23

PROCESS FOR REDUCING THE SULFUR CONTENT OF COAL

This invention relates to methods for reducing the sulfur content of coal.

In a more particular respect, the invention concerns processes for extracting sulfur impurities from raw coal which also contains water.

According to a further and more specific aspect, the invention relates to processes for desulfurizing or at least significantly reducing the sulfur content of raw coal which are especially adapted for use in electrical power generation plants utilizing coal-fired steam generation equipment.

In yet another respect, the invention pertains to an overall integrated process for producing electrical power in coal-fueled electrical generation facilities with reduced atmospheric pollution due to sulfur emissions.

Air pollution from the combustion of fossil fuels has long been recognized as a major environmental problem and emphasis has been placed by both governments and industry on the development of methods for controlling and reducing emissions of sulfur dioxide and particulate pollutants.

Coal-fired electrical utility plants are the major source of sulfur dioxide air pollution in the United States. If air pollution is to be controlled and reduced, it is imperative that sulfur dioxide emissions be controlled.

The available methods for controlling sulfur dioxide emissions from stationary combustion sources such as electrical utility plants consist of the physical removal of pyritic sulfur prior to combustion, the removal of sulfur dioxide from the combustion gases, and conversion of coal to a clean fuel by such processes of gasification or liquefaction.

Sulfur in coal may occur in several forms:

(a) elemental sulfur;

(b) organic sulfur compounds which form an integral part of the coal matrix;

(c) water-soluble sulfate compounds; and (d) the mineral pyrite which occurs in coal as discrete particles.

Elemental sulfur and organo-sulfur compounds usually comprise from 30% to 70% of the total sulfur of most coals and are impossible to remove by simplified washing or floatation techniques which can be used to remove or substantially reduce the water-soluble sulfate impurities and pyrites.

Thus, washing and floatation processes which have been heretofore employed to reduce the sulfur content of raw coal are ineffective to reduce or eliminate the elemental sulfur and organo-sulfur compounds which may comprise most of the sulfur impurities in raw coal.

Various processes have been proposed to separate elemental sulfur and organo-sulfur compounds from raw coal but these processes have generally converted the particulate coal to a liquid or gaseous form which cannot be utilized in conventional existing coal-fired electrical generating plants without major modification. Such liquefaction or gasification procedures generally utilize very expensive and highly sophisticated equipment.

Accordingly, it would be highly desirable to provide methods for reducing the sulfur impurity content of raw coal by simplified procedures which utilize less expensive and less complicated equipment and which produce a coal product which can be directly and advantageously employed as the fuel for conventional existing electrical power generation facilities.

Therefore, the principal object of the present invention is to provide an improved method and process for reducing the sulfur content of raw coal.

Yet another object of the invention is to provide such methods and processes which produce a coal product which is directly usable as the fuel in conventional coal-fired electrical power generating plants.

Still another object of the invention is to provide simplified and more economical processes for desulfurizing raw coal which substantially reduce the elemental sulfur and organo-sulfur impurities level in the coal while also separating the more easily removed sulfate and pyrite impurities.

A further and more specific object of the invention is to provide an overall integrated process for generating electrical energy in a coal-fired power plant with markedly reduced emission of sulfur dioxide pollutants.

These and other, further and more specific objects and advantages of the invention will be apparent to those skilled in the art from the following detailed description thereof, taken in conjunction with the drawing which schematically depicts the steps of processes which embody the present invention.

Briefly, in accordance with the invention, I provide a process for reducing the sulfur content of raw coal which contains sulfur impurities and water. My process comprises comminuting the raw coal in a vapor-tight extraction zone in contact with a combustible sulfur solvent at an elevated temperature. This procedure forms an extraction mixture slurry which includes a liquid component comprising the solvent containing dissolved sulfur impurities and a solid component comprising the comminuted, extracted coal. The liquid and solid components of the extraction mixture slurry are separated and, preferably, at least a portion of the liquid component is treated by any suitable means to separate sulfur therefrom. The liquid component is recycled to the extraction zone.

In those coals which contain a high percentage of pyrite, the solid component of the extraction mixture slurry is then reacted with a reagent to decompose the pyrites to water-soluble sulfur compounds and the reaction mixture is then washed with water to separate the water-soluble sulfur compounds and other reaction by-products from the comminuted extracted coal.

In my U.S. Pat. No. 3,063,817, issued Nov. 13, 1962, I disclosed processes for extracting sulfur from materials containing elemental sulfur such as various low-grade ores, tailings from smelter operations, residues produced from the precipitation of solids from stack gases and spent oxides from gas works. The processes described in my patent involved crushing the sulfur-bearing material and drying it to remove moisture which produced undesirable side reactions. The crushed dried material was then pre-heated to an elevated temperature below the melting point of sulfur and the dried, pre-heated sulfur-bearing material was then extracted with a hydrocarbon solvent at an elevated temperature not exceeding 132° C.

While the processes described in my issued U.S. Pat. No. 3,063,817 efficiently removes elemental sulfur from various materials, it has not been possible to utilize such process for the extraction of sulfur impurities in coal because part of the sulfur impurities in coal exist as organo-sulfur compounds, sulfates and pyrite, as described above. Thus, in order to achieve satisfactory reductions in the sulfur content of coal, it has been necessary to depart from the process of my prior patent in significant respects.

In order to extract organo-sulfur impurities which form an integral part of the coal matrix, I deliberately adjust the process conditions to promote the in situ formation of hydrogen sulfide which reacts with the water present in the raw coal to form sulfurous acid. To bring about this reaction, I grind the coal in intimate contact with a hot hydrocarbon solvent. Grinding the coal facilitates breaking the water molecules away from the coal particles and, by maintaining the temperature in the grinder above 100° C., the water vapor thus formed reacts with hydrogen sulfide (formed by reaction of the hot hydrocarbon solvent with sulfur impurities) to form hydrosulfurous acid in situ. The hydrosulfurous acid then apparently reacts with the organo-sulfur impurities in the coal matrix and chemically decomposes the organo-sulfur impurities to elemental sulfur which is soluble in the hot solvent. The comminuting and extracting steps are carried out in a vapor-tight enclosure which may advantageously consist of an enclosed grinder which is vented to remove water and solvent vapors. The coal is ground in contact with a quantity of the hot solvent and the resultant mixture is discharged into a stirred enclosed extraction vessel. Vapors withdrawn from the grinder are reinjected below the surface of the slurry in the extraction vessel.

The coal is comminuted in the grinder to approximately 20 mesh, which produces a coal product which flows freely after the removal of sulfur impurities. Although grinding the coal more finely would promote the water release and sulfur extraction mechanisms, I prefer to crush the coal only to approximately 20 mesh, as crushing the coal to a smaller size would produce a higher proportion of "fines" which would then present handling problems as well as promote spontaneous combustion.

The exact solvent employed in the crushing-extraction step is not highly critical so long as it will dissolve sulfur and sulfur-bearing compounds without dissolving or undesirably softening the coal particles. The hydrocarbon solvents disclosed in my issued U.S. Pat. No. 3,063,817 are ideally suited as solvents in the present process. These are open-chain hydrocarbons which include olefinic and parafinic liquid hydrocarbons such as $C_7$–$C_{18}$ parafins and olefins and mixtures thereof. These solvents and solvent mixtures are readily available as gasoline and naphta fractions, kerosene, diesel oil and stove oil. The solvents described above are also ideally suited for use in the present process in that they are readily combustible and the residual solvent remaining in the sulfur-extracted coal need not be separated from the coal in order to make the process economically feasible. Rather, the residual solvent merely contributes to the energy value of the extracted coal.

The comminuting-extracting step is carried out at an elevated temperature. Advantageously, the process is carried out at a temperature above 100° C. to insure that any water separated from the coal is vaporized to promote the formation of hydrosulfurous acid.

After the hot, wet grinding step, the coal is mixed with additional solvent in the extraction vessel in a ratio of solvent to coal of from 1:1–5:1 by weight, depending on the amount of sulfur impurities to be extracted. The coal and hot solvent are agitated for a sufficient time to extract the elemental sulfur and any converted organo-sulfur that can be dissolved by the solvent, thus forming an extraction mixture slurry. The liquid component of the slurry includes the solvent with sulfur impurities from the raw coal dissolved therein. As previously mentioned, this will include both elemental sulfur which was present in the raw coal as well as solvent soluble sulfur compounds or elemental sulfur formed by the reaction of the organo-sulfur impurities with hydrosulfurous acid. The solid component of the slurry is the comminuted, sulfur-extracted coal.

After the completion of the solvent extraction procedure described above, the slurry is discharged from the extraction vessel and the solid and liquid components of the slurry are separated by any suitable procedure such as settling-decantation, filtration, centrifuging or the like. I prefer to employ a centrifugal separator which can be totally enclosed and which rapidly separates the solids from the slurry, leaving a minimum of residual liquid.

The liquid components separated from the slurry is then recycled to the grinding-extraction step. When the sulfur content of the liquid component contains enough sulfur to warrant economical separation, a sidestream of the solvent can be subjected to sulfur recovery procedures and the regenerated solvent sidestream is then recycled to the extraction step.

Any suitable sulfur separation procedure can be employed to regenerate the solvent. For example, the solvent sidestream may be cooled to about 90° C. to crystallize the sulfur from the solution which is then separated from the mother liquor by filtration. Alternatively, by heating the liquid component of the extraction mixture slurry to a temperature of about 135° C. or higher, the dissolved sulfur will liquify and can be separated from the solvent by simple decantation.

If the solids from the extraction step still have an undesirably high sulfur content, the pyritic sulfur (which is not removed in the extraction step) can be reduced by reacting the extracted coal solids with a reagent which chemically decomposes the pyrite to yield water soluble sulfur compounds and reaction by-products. Advantageously, the extracted solids are fed into another agitated tank and a slurry is formed with hot water and aluminum chloride reagent. The reaction between the aluminum chloride and the pyrite forms ferric chloride and aluminum sulfate, which are removed by washing the reaction mixture with hot water.

The pyrite decomposition reagent can be any compound which reacts with pyrite ($FeS_2$) to form soluble sulfur by-products. Advantageously, because of cost and availability, I preferably employ aluminum chloride, zinc chloride or ferric chloride in stoiciometric quantities based on the pyrite content of the extracted coal.

The drawing illustrates an overall integrated process for producing electrical power in coal-fueled electrical generation facilities with reduced atmospheric pollution due to sulfur emissions. Raw coal 11 is subjected to the hot grinding and solvent extraction step 12, as described above, with in situ formation and utilization of hydrosulfurous acids 13 (indicated by dashed lines). The grinding and solvent extraction mixtures are heated by waste heat 14 from a coal-fired power plant 15. After completion of the grinding-solvent extraction step 12, the resultant slurry 16 is subjected to solvent separation procedures 17 to separate the slurry 16 into a solids component 18 and a liquid component 19.

The liquid component 19 from the solvent separation step 17 consists of the solvent employed in the solvent extraction step 12 containing dissolved elemental sulfur which was present in the raw coal 11 and/or which was formed by the decomposition of organic sulfur materials in the raw coal 11 by the sulfurous acid 13 formed in situ during the grinding-solvent extraction step 12. The solvent containing dissolved sulfur is recycled 20 to the grinding-solvent extraction step 12. As the sulfur content of the liquid component 19 approaches saturation, a sidestream 21 of the liquid component 19 is subjected to sulfur recovery procedures 22, as described above, to separate the sidestream into an elemental sulfur product 23 and a regenerated solvent stream 24 which is recycled to the grinding-extraction step 12. Fresh make-up solvent 25 is introduced, as required.

The solids component 18 from the solvent separation step 17 consists of the ground extracted coal produced in the grinding-extraction step 12 plus residual solvent. If the sulfur content of the solids component 18 is low enough, it can be used directly as the fuel for the coal-fired power plant 15, as indicated by the dashed line 26. On the other hand, if the sulfur content of the solids 18 is undesirably high, the solids component 18 is subjected to pyrite decomposition procedures 27 in which a decomposing reagent 28 is reacted with the solids component 18 to convert pyrites to water-soluble sulfates. The reaction mixture 29 from the pyrite decomposition step 27 is washed with water 30 to separate the soluble sulfate reaction product 31 and the wet low-sulfur coal 32 can either be fed directly to the coal-fired power plant 15 or subjected to intermediate optional drying procedures 33.

As will be observed, the procedures illustrated in the drawing reduce the $SO_2$ emissions from the coal-fired power plant for two reasons. First, the sulfur content of the raw coal 11 is reduced, thereby reducing the weight of sulfur dioxide which will be produced from the burning of a given weight of coal. Secondly, the residual solvent remaining in the low sulfur coal stream increases the energy content of the fuel 26 fed to the power plant such that a given quantity of electricity can be generated by burning a smaller amount of the low sulfur coal.

The following examples illustrate the practice of the invention by describing the presently preferred embodiments thereof.

EXAMPLE 1

A sample of "blue seam" coal mined at Gallup, New Mexico was obtained. The coal contained 4% water and had an energy content of 11,330 BTU/lb. The coal was analyzed for mineral and sulfur content and the following results were obtained.

Table A

| Minerals in Ash | |
|---|---|
| Mineral | Wt. % |
| $P_2O_5$ | .12 |
| $SiO_2$ | 65.05 |
| $Fe_2O_3$ | 3.80 |
| $Al_2O_3$ | 20.54 |
| $TiO_2$ | 1.24 |
| CaO | 3.21 |
| MgO | .92 |
| $SO_3$ | 2.36 |
| $K_2O$ | .89 |
| $Na_2O$ | 1.76 |
| Und | .11 |

Sulfur

| Form | Wt. % in Raw Coal |
|---|---|
| Pyritic | .13 |
| Sulfate | .06 |
| Organic | .55 |
| Elemental | .20 |

Grinding-Extraction-Solvent Separation

The coal sample of Table A was crushed to 20 mesh in an enclosed grinder with kerosene (51.5 lbs/cu. ft.; 18,000 BTU/lb. ) heated to 125° C. The weight ratio of solvent to coal in the grinder was 1:1. After the coal was reduced to 20 mesh, the crushed coal and solvent were introduced into a stirred reactor and additional kerosene was added to increase the ratio of solvent to coal in the reactor to 3:1.

Agitation of the coal and solvent in the reactor was continued for 30 minutes and the resultant slurry was separated into solid and liquid components in an enclosed centrifuge. The liquid component (kerosene containing dissolved sulfur) was recycled to the grinding-extraction vessels. The solids component of the slurry contained 5% pregnant kerosene solvent and 1% water and had an energy content of 12,230 BTU/lb.

The total sulfur in the crushed extracted coal was 0.23%, as follows:

Table B

| | Wt. % |
|---|---|
| Elemental Sulfur | .03 |
| Pyritic Sulfur | .13 |
| Sulfate | .01 |
| Organic | .06 |

The raw coal of Table A would produce $SO_2$ emissions from the power plant of 1.45[1] lbs. of $SO_2$ per million BTU, whereas the ground extracted coal of Table B can be burned with sulfur emissions of less than 0.5[1] lbs. $SO_2$ per million BTU. The current emissions standards for coal-fired power plants promulgated by the Environmental Protection Agency is 1.2 lbs. $SO_2$ per million BTU or less.[1]

[1]Above sulfur emissions calculated by use of nomograph found at page 9 of Bureau of Mines Report of Investigations RI8118 published by United States Department of Interior (1976).

Sulfur Recovery-Solvent Regeneration

The kerosene solution of sulfur discharged from the centrigue is recycled to the grinding-extraction vessels and the recyling is continued until the sulfur content of the solution reaches 17.3%. At this point, a sidestream of the kerosene-sulfur solution (20% of the recirculating solvent) is withdrawn from the circuit and passed to a heated tank which maintains the temperature of the solution at 100° C. The hot solution is passed through a pressure leaf filter and a cartridge-type polishing filter to remove any suspended coal fines. The clarified kerosene solution of sulfur is then passed to a heat exchanger where it is heated to 140° C., which results in a two-phase liquid system comprising kerosene and liquid sulfur. The two-phase system is passed to a liquid centrifuge which separates the two phases (4.8 lbs. of kerosene per lb. of sulfur) and the regenerated kerosene solvent is recycled to the grinding-extracting vessels. The molten sulfur phase is cast into solid blocks and analyzes 99+% sulfur.

EXAMPLE 2

A sample of New Mexico fuschia coal containing 6.4% total sulfur was subjected to the grinding-extraction procedures of Example 1. The sulfur content of the extracted coal was 2.5%, virtually all of which was pyritic sulfur. The extracted coal was mixed with a stoiciometric quantity of aluminum chloride, based on the pyrite content of the coal. The mixture was heated and agitated in the absence of air at a temperature of 500° C. for 30 minutes, which resulted in the decomposition of the pyrite to yield aluminum sulfate and iron chloride. The reaction mixture was cooled and washed with hot (90° C.) water to dissolve the aluminum sulfate and iron chloride. The washed coal residue contained less than 0.1% sulfur.

Having described my invention in such terms as to enable those skilled in the art to understand and practice it and having identified the presently preferred embodiments thereof, I claim:

1. A process for reducing the sulfur content of raw coal containing sulfur impurities and water, comprising the steps in sequence of:

(a) comminuting said raw coal in a vapor-tight extraction zone in contact with a combustible solvent for sulfur at an elevated temperature to form sulfurous acid in situ and continuing said contact to form an extraction mixture slurry, including (i) a liquid component comprising said solvent containing sulfur impurities from said raw coal dissolved therein, and (ii) a solid component comprising said comminuted, extracted coal;

(b) separating said liquid and solid components of said extraction mixture slurry.

2. The process of claim 1, which includes the further steps in sequence of:

(a) reacting said separated solid component comprising comminuted, extracted coal with a reagent selected from the class consisting of aluminum, zinc and ferric chlorides to decompose pyrites therein to water-soluble sulfur compounds; and (b) washing the reaction mixture of step (a) with water to separate said water-soluble sulfur compounds and reaction by-products from said comminuted, extracted coal.

* * * * *